US005573293A

United States Patent [19]

Baumann et al.

[11] Patent Number: 5,573,293

[45] Date of Patent: Nov. 12, 1996

[54] SIDE LATCH ASSEMBLY FOR LIFTING TRAILERS AND CONTAINERS

[75] Inventors: James A. Baumann, Orland Park; Joel G. Kuchcik, Crete; John J. Lanigan, Sr., Orland Park, all of Ill.

[73] Assignee: Mi-Jack Products, Inc., Hazel Crest, Ill.

[21] Appl. No.: 553,146

[22] Filed: Nov. 7, 1995

Related U.S. Application Data

[62] Division of Ser. No. 229,721, Apr. 19, 1994, Pat. No. 5,470,189.

[51] Int. Cl.[6] ..... B65D 90/00

[52] U.S. Cl. ..... 294/68.1; 294/68.3; 220/1.5

[58] Field of Search ..... 294/68.1, 68.3, 294/81.5, 81.51, 81.54; 220/1.5; 296/181

[56] References Cited

U.S. PATENT DOCUMENTS 5,318,335 6/1994 Ehrlich ..... 294/68.3

5,332,274 7/1994 Baumann ..... 294/68.3

5,382,066 1/1995 Kelly ..... 294/68.3

*Primary Examiner*—Dean Kramer

*Attorney, Agent, or Firm*—Robert A. Brown

[57] ABSTRACT

An apparatus for lifting truck trailers and cargo containers is provided and includes a plurality of side latch assemblies. A side fitting connection device is secured to four predetermined locations on external upper side locations of a trailer or a container. Each side latch assembly includes a complementary shaped member adaptable to engage with and be secured to each side fitting device. The side fitting devices and side latch assemblies, when connected and engaged together, permit top side lifting of trailers and containers for intermodal movement thereof. The external upper side locations of the side fitting device permit full, complete and more profitable usage of the internal space of volume of truck trailers or cargo containers.

12 Claims, 4 Drawing Sheets

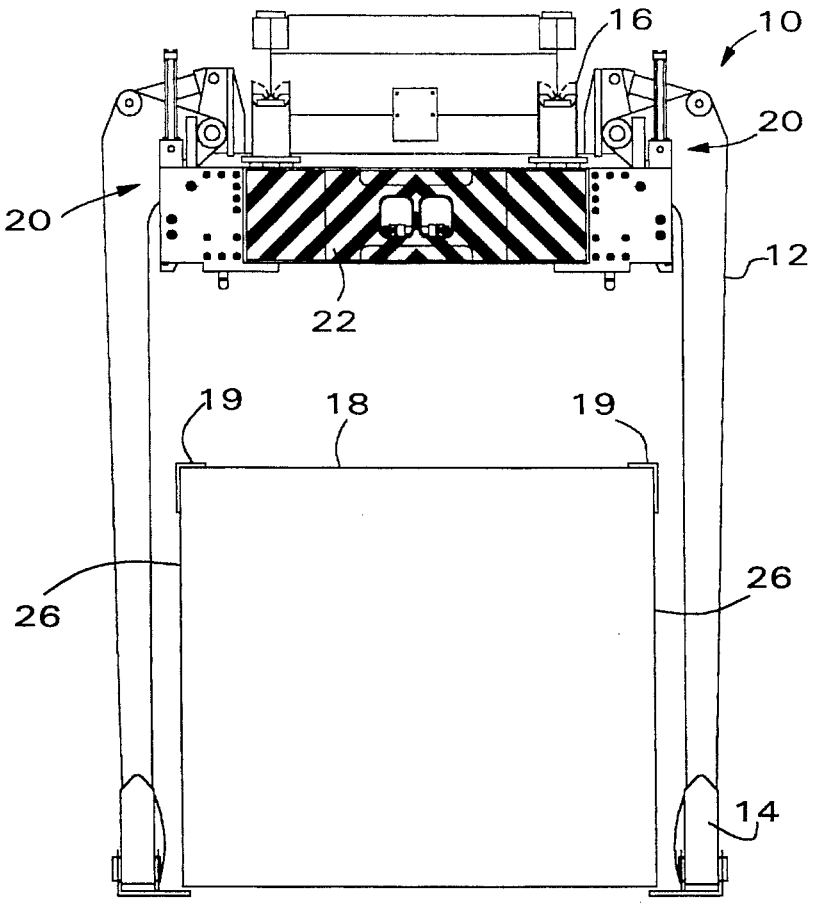
FIG. 1
FIG. 2
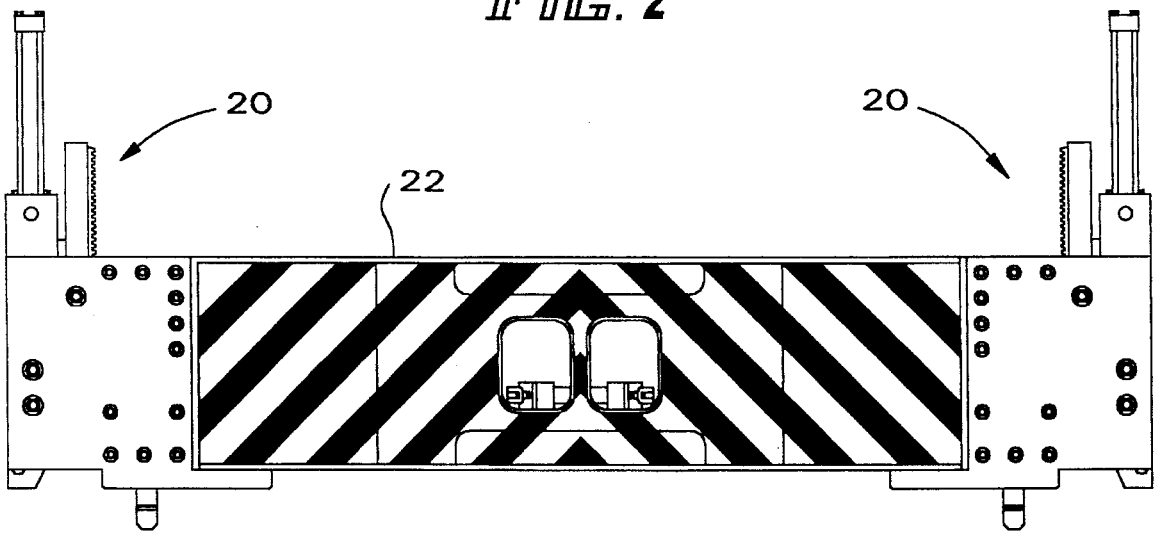

SIDE LATCH ASSEMBLY FOR LIFTING TRAILERS AND CONTAINERS

This is a division of application Ser. No. 08/229,721 filed Apr. 19, 1994 now U.S. Pat. No. 5,470,189.

BACKGROUND OF THE INVENTION

The present invention relates generally to the handling of truck trailers or transport containers and more particularly to an assembly and method for connection to a fitting secured to an upper side surface of a truck trailer or a cargo container so as to facilitate lifting thereof. The fitting may be a casting or other suitably constructed member secured to and disposed at a predetermined external location on the trailer or container. The side latch assembly includes structure that is at times adaptable to be moved into contact with the fitting, securely interlocked therewith and controllably releasable therefrom.

DESCRIPTION OF THE PRIOR ART

The transportation industry requires and uses a number of different types of tractor-trailer rigs for over the road movement of goods and products in interstate commerce. In addition, goods and products are shipped from one place to another in cargo containers mounted on railroad flat cars. Also, these containers may be transferred from flat cars into holds of ocean going vessels for transportation of goods and products to overseas destinations. In order to handle a diverse array of goods and products at a minimum cost and greatest economic benefit in shipment from one section of the country to another, or overseas, it is necessary to transfer truck trailers and/or containers intermodally, or from road to rail car, or vice versa.

Generally, in the past, it has been the custom to drape and attach a grappling arm and hook apparatus over and about a truck trailer in order to lift it from a roadway and place it on a railroad flat car, a loading system known as Trailer On Flat Car (TOFC). A similar procedure has been used to transfer a cargo container from a railroad siding storage area or from a ship's hold to a railroad flat car, this system being known as Container On Flat Car (COFC). Also, it is customary to provide bottom side connection fittings that are releasably attached to receiving receptacles disposed on the top side of a trailer or container that includes twist lock devices, and the like, in order to safely secure stacked trailers or containers during movement of a freight train along a railroad track. The need to attach grapple hooks to a bottom side of a trailer is inefficient and time consuming. Furthermore, presently used top side fittings disposed on a trailer or container require receptacles for receiving pins secured at the lower ends of the latching arms. The receptacle and pin assembly intrudes into the inside storage space or volume available for packing and transporting merchantable goods and products. Thus, a potential "pay load" is greatly reduced and adversely affects the bottom line profit that can be realized in the movement of goods from one location to another.

Accordingly, providing an improved side latch assembly for attachment to upper side fittings that are located on outside surfaces or externally of a trailer or a container serves a dual purpose. There is a first advantage in permitting more efficient handling of a trailer from above, rather than using grapple arm hooks at a bottom side of the trailer, or by using latching arm pins at an upper side of the trailer. A second advantage is obtained by utilization of all available internal volume or storage space of a trailer or container for loading and transporting therein a maximum amount of goods and products. Thus, the present invention eliminates any intrusion or inward projections into the inside storage space of a trailer or container and thereby "frees up" or makes available increased cargo capability within the trailer or container that can be translated into additional revenue and higher profits. In addition, the present invention provides a side fitting that permits the use of current pin connection as well as the side latch assembly disclosed herein.

SUMMARY OF THE INVENTION

Therefore, it is a primary object of the present invention to provide a side latch assembly that includes a side fitting means attached to a predetermined position at an external upper side location on a trailer or container for receiving an interlocking securing means that is adaptable to be fixedly received therewithin.

It is a further object of the present invention to provide a side latch assembly for releasable attachment to an external location on a truck trailer or cargo container for selectable lifting thereof.

An additional object of the present invention is to provide a side latch assembly adaptable for attachment to an external upper side location on a tractor trailer or cargo container for lifting thereof while maintaining therein an unobstructed and completely usable internal volume of space.

Another object of the present invention is to provide a side latch assembly adaptable for external upper side attachment to a truck trailer for lifting thereof while maintaining its structural design integrity.

A still further object of the present invention is to provide a side latch assembly for vise-like attachment to an upper side location on a truck trailer having a thin walled, lightweight skin structure without causing failure or deformation thereof.

An additional object of the present invention is to provide a side latch assembly for attachment to and lifting of a truck trailer that includes a plurality of side fittings disposed on the trailer for receiving a like plurality of interlock means whereby the trailer may be positioned in a locking arrangement with another trailer or a container deposed on a railroad car.

A still further object of the present invention is to provide a side fitting means and side latch assembly means for maintaining at preselected upper side locations on a truck trailer vertical and horizontal force vectors so as to maintain a secure vise-like grip between the side latch assembly means and the side fitting means of the trailer.

Another object of the present invention is to provide a truck trailer or cargo container including side fitting means secured externally at preselected upper side locations thereon for at times engaging with components of a side latch assembly and at other times engaging with connecting pins deployed from a lifting apparatus in order to facilitate movement of the truck trailer or cargo container from one location to another.

These and other objects are achieved in accordance with the present invention wherein there is provided an improved side latch assembly for lifting a load carrying structure used for intermodal transportation, such as a truck trailer or cargo container including apparatus supporting spreader means for raising or lowering the structure from one elevation to another and from one location to another comprising side fitting means mounted to an upper side location on an external surface of the structure, horizontal beam means suspended from the spreader means, vertical arm means for movement along the side wall of the structure and adjustable for at times engaging the side fitting means in secure interlocked connection therewith.

The above and additional objects are achieved in accordance with the present invention wherein there is provided an improved load carrying structure comprising a plurality of side fitting means mounted externally at predetermined upper side locations on the structure and spaced apart so as to provide predetermined span lengths therebetween, each said side fitting means comprising body means having an upper horizontal flange member installed substantially coincident with the roof line of the trailer, a vertical flange member extending downwardly from said horizontal flange member and secured on the external side wall of the trailer, the vertical flange member having formed therein a depressed triangular cavity means and a generally rectangularly shaped depressed box-like receptacle section including downwardly oriented linear notch means.

The above and further objects are achieved in accordance with the present invention wherein there is provided a side fitting connection member comprising body means having an upper horizontal flange member, a vertical flange member, the vertical flange member having formed therein a depressed triangular cavity section and a generally rectangularly shaped cut out box-like receptacle section including having formed therein linear notch means.

BRIEF DESCRIPTION OF THE DRAWING

The foregoing and other characteristics, objects, features and advantages of the present invention will become more apparent upon consideration of the following detailed description, having reference to the accompanying figures of the drawing, wherein:

FIG. 1 is a front elevational view of a load supporting apparatus including a spreader assembly depending therefrom whereon is disposed a latching mechanism adaptable to interlock with and be securely affixed to a side fitting member attached to an upper side surface at four predetermined locations on a truck trailer or a cargo container in accordance with the present invention.

FIG. 2 is an enlarged front elevational view of the latching mechanism shown in FIG. 1.

DESCRIPTION OF A PREFERRED EMBODIMENT

Figure 5:
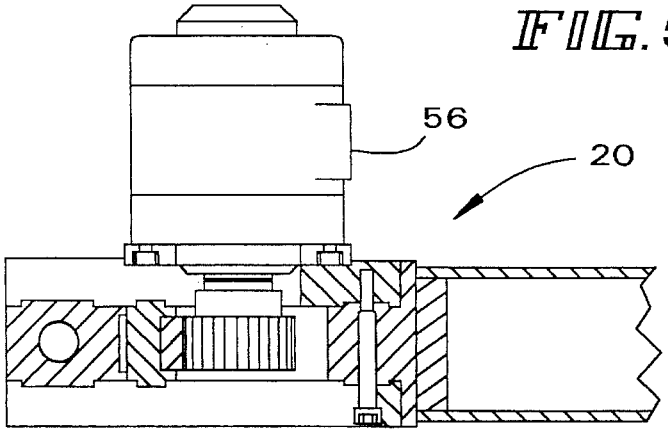
FIG. 5 is a top plan partially sectioned view of the side latch assembly in accordance with the present invention.
Figure 4:
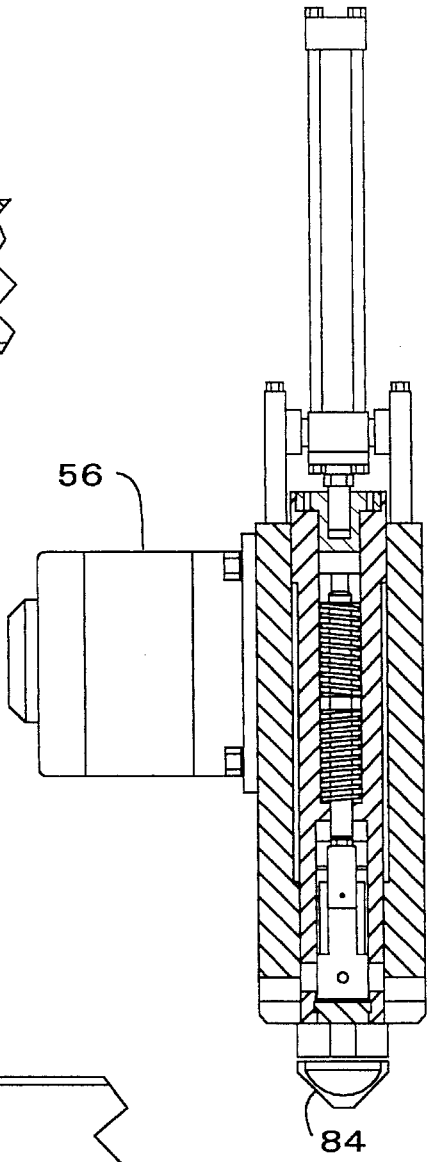
FIG. 4 is a side elevational sectioned view of the side latch assembly in accordance with the present invention.

Referring now to FIG. 1 there is shown a load supporting and lifting apparatus, generally indicated by reference numeral 10, capable of directed movement along ground level and adaptable for lifting and transporting one or more of a stack of load carrying structures, such as truck trailers or cargo containers used in intermodal roadway shipping and railroad freight car transportation applications. The apparatus 10 includes a plurality of supporting frame assemblies constructed to include horizontal beams or girders as is known in the prior art. The lower portion of each supporting frame includes a pair of upright corner columns 12 disposed on a selected number of pivotally attached wheel assemblies 14, suitably powered by drive means (not shown) for moving the apparatus along ground level. The supporting assemblies may be connected fore and aft by the beams and contain therein a spreader assembly mechanism 16 depending from a stabilizing beam or other suitable means. The spreader assembly mechanism is operable to move upwardly and downwardly so as to position itself for attachment to a working load, such as a trailer or container 18. The trailer 18 has secured at each of four preselected locations on its external upper side walls a side fitting connection member generally identified by reference numeral 19. The apparatus thus described is effective to move along and span a transportation container work place, a plurality of roadways, railroad tracks and containers from flat bed trucks to railroad freight cars and vice versa.

Figure 11:
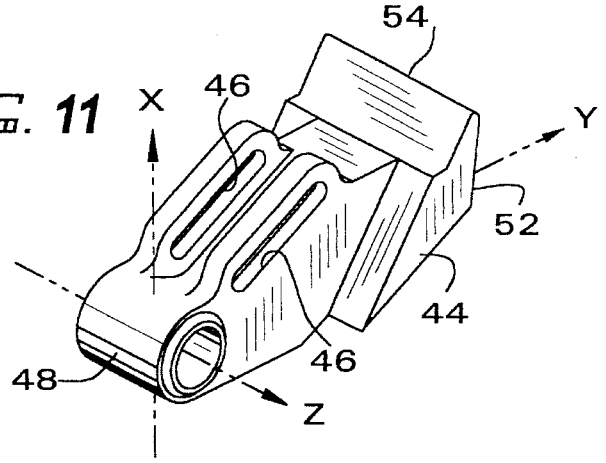
FIG. 11 is a perspective view of an integral part of a latch arm assembly for interlocking engagement with a side fitting connection member in accordance with the present invention.

Now referring to FIGS. 2–5, the spreader mechanism 16 supports therebelow a plurality of side latch assemblies, generally indicated by reference numeral 20, for positioning and placement above the roof or on top of the trailer or container at predetermined locations thereon. Each side latch assembly 20 includes at each distal end of a horizontal beam 22 an upright latch arm member 24 for movement vertically along an upper side wall 26 of the trailer 18. The side latch assembly 20 comprises a vise bar 28 secured to a rack 30 that meshes with a spur gear 32 for at times causing the latch arm 24 to move upwardly and downwardly in proximity with the side wall 26. The side latch assembly further includes a housing 34 wherein is contained a spring loaded piston 36 having one end 38 restrained against an internal wall portion of the housing and having a clevis 40 secured at its other end. The clevis 40 includes a substantially horizontal pin 42 located thereon. A body member or tenon 44 (best shown in FIG. 11) is disposed at a lower end of the housing 34 and has formed therethrough two slots 46 for receiving the pin 42 of clevis 40 in slidable contact therebetween. A first end 48 of the tenon 44 is rotatable around a shaft 50 secured within the lower end of the housing. A second end 52 of the tenon 44 has formed thereat a hook member 54. An actuator member 56 or other suitable means is provided to rotate the spur gear 32 so as to move the latch arm 24 vertically along the side wall 26 of the trailer 20.

The side latch assembly 20 also includes an approach sensor 58 for determining proximity to the top side of the trailer as the spreader assembly is lowered downwardly toward the working load. A landing pad 60 is provided at a lower end of the vise bar 28 for making contact with an upper horizontal side of the fitting 19 and an alignment pad 62 is effective to guide the latch arm 24 as it moves alongside of the fitting 19 secured to the external side wall 26 of the trailer 18. The spring loaded piston 36 is operable by suitable means to extend downwardly so as to position the tenon 44 a preselected distance below the fitting 19 and simultaneously rotate the tenon downwardly and outwardly so as to locate its hook member 54 adjacent the fitting 19. The arm 24, by operation of actuator member 56 may then be raised so that the hook member 54 engages and interlocks with the side fitting 19 in a manner that will be hereinafter explained in greater detail.

Figure 7:
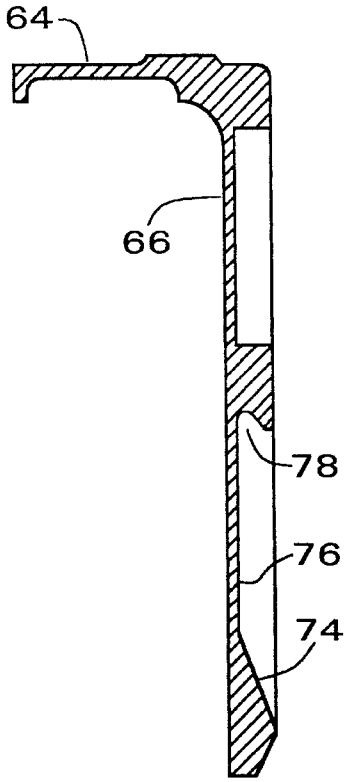
FIG. 7 is a side elevational view in section of the side fitting connection member taken along lines 7—7 of FIG. 6.
Figure 6:
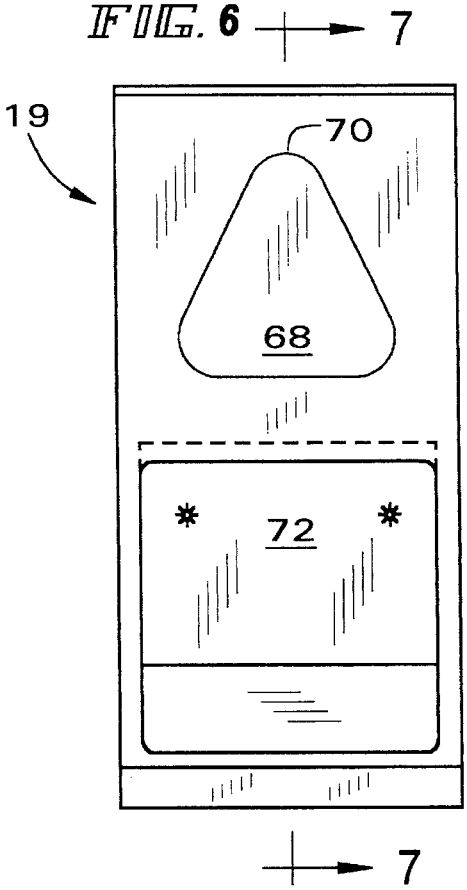
FIG. 6 is a front elevational view of a side fitting connection member for attachment to an external upper side surface of a trailer in accordance with the present invention.
Figure 8:
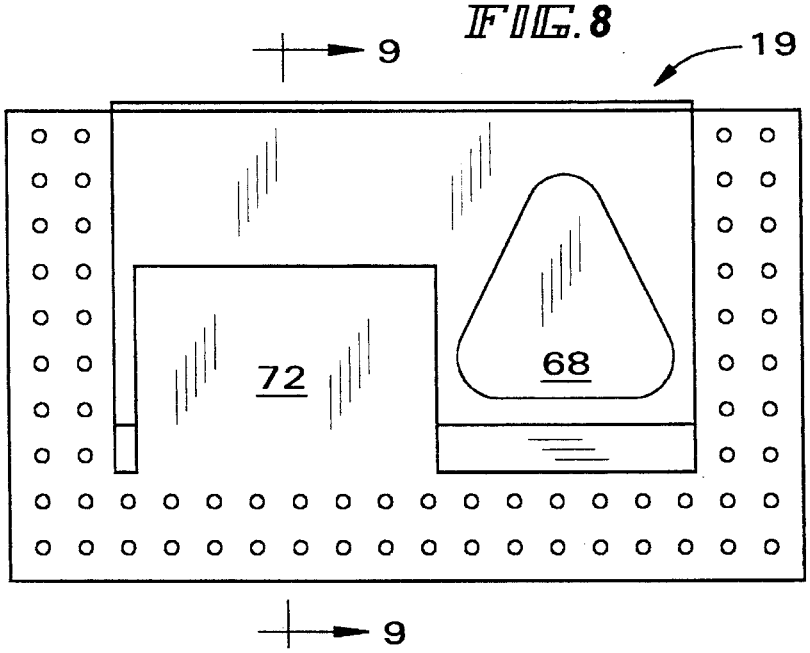
FIG. 8 is a front elevational view of an alternate embodiment of a side fitting connection member for attachment to an external upper side surface of a trailer in accordance with the present invention.

Each side fitting member 19, best shown in FIGS. 6–8, comprises an upper horizontal flange portion 64 that is installed in any desired location on the top side of the trailer, preferably coincident with the roof line thereof. The fitting member 19 includes also a vertical flange portion 66 that extends downwardly along an external upper side surface wall or skin of the trailer. In the embodiment shown in FIGS. 6 and 7, there is formed a generally triangularly shaped or hollowed out cavity section 68 having an apex 70 oriented upwardly toward the top side of the trailer. It will be noted cavity section 68 is adaptable to receive and retain therein connecting pins attached to latching arms for lifting the trailer 18 as is well known in the art. A generally rectangularly shaped depressed or hollowed out box-like receptacle 72 is formed in flange 66 at a lower end thereof having a ramp wall 74, a back wall 76 and a linear upper notch 78. The upper notch 78 is formed to be complementary to a linear edge of the hook member 54 of tenon 44 in accordance with the present invention.

Figure 9:
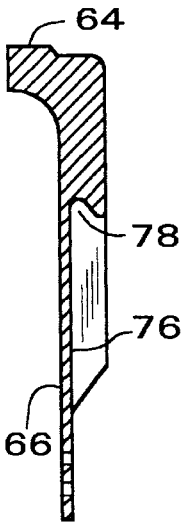
FIG. 9 is a side elevational view in section of the side fitting connection member taken along lines 9—9 of FIG. 8.

In the embodiment of FIGS. 8 and 9, it will be noted that container section 68 and receptacle 72 are oriented on the fitting 19 in a side by side relationship rather than one above the other as depicted in FIGS. 6 and 7. The function and operation of the fitting 19 remain constant regardless of where or how cavity section 68 and receptacle 72 are located with respect to each other on the fitting 19.

Figure 3:
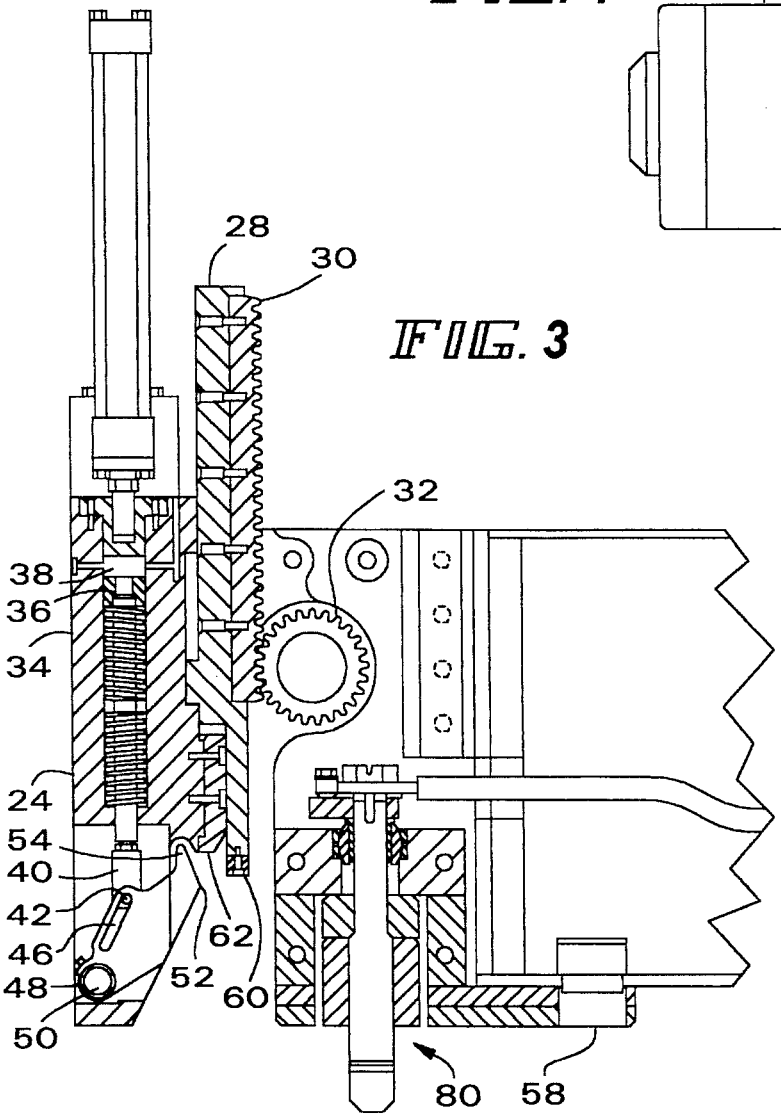
FIG. 3 is a front elevational sectioned view of a side latch assembly in accordance with the present invention.
Figure 10:
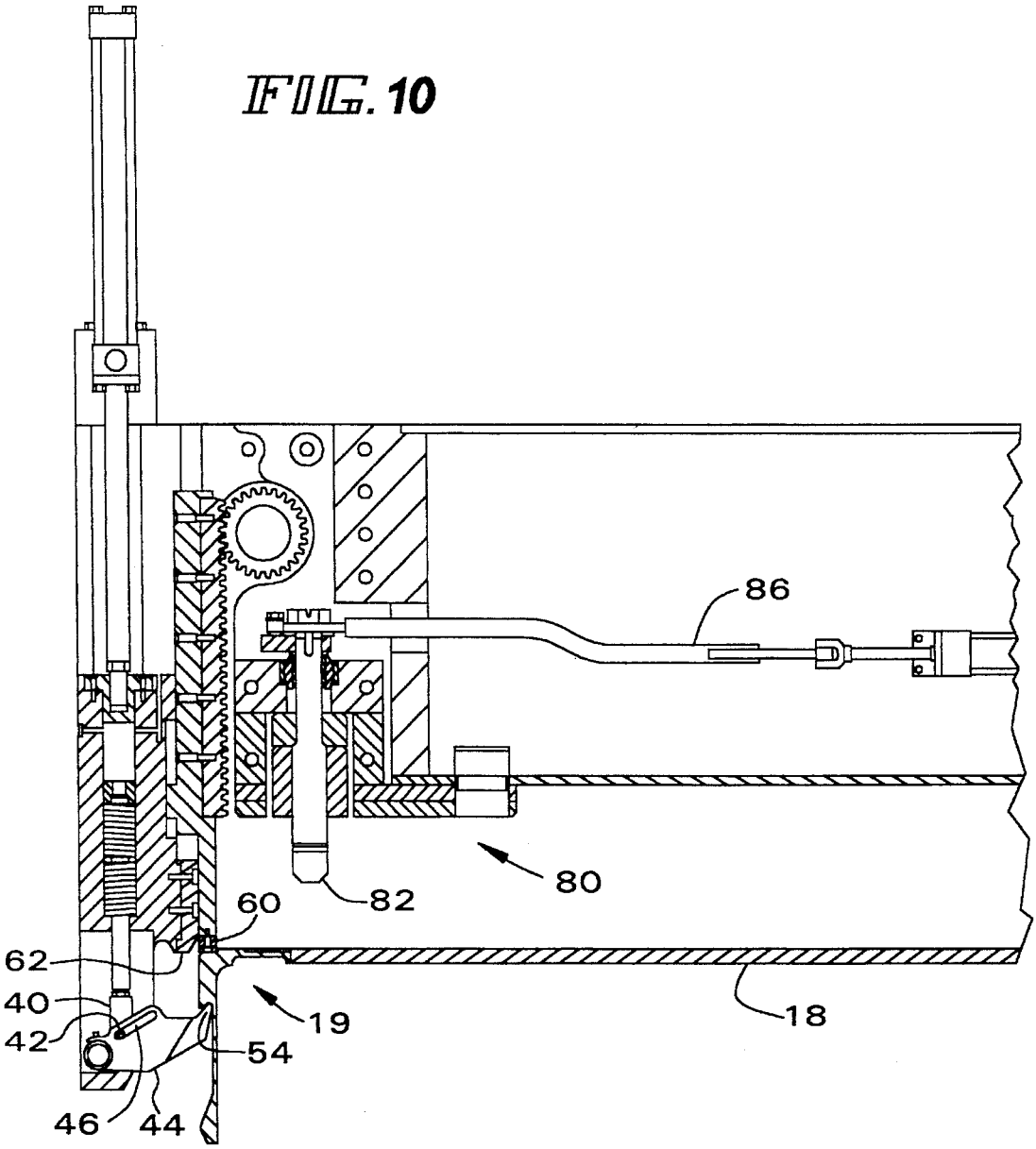
FIG. 10 is a side elevational view in section of the side latch assembly engaged in an interlocked relationship with a side fitting connection member in accordance with the present invention.

The side latch assembly as best seen in FIGS. 3 and 10 also includes a twist lock connection device generally identified by reference numeral 80. The twist lock 80 comprises a vertical pin 82 having disposed at its lower end a locking arm 84 (FIG. 4) engaging with a side or a corner fitting as is well known in the prior art. The pin 82 is selectively rotated by a suitable linkage 86 in order to secure the locking arm 84 within the fitting or to release it therefrom.

Next referring to FIGS. 1–4, the side latch assembly 20 is shown in a disengaged position with the side fitting connection member 19. FIG. 10 illustrates the manner in which the side latch assembly 20 is engaged in an interlocking relationship with the side fitting connection member 19 which is suitably secured and anchored to a preselected external upper side location of and on the trailer 18.

The side latch assembly 20 as explained hereinabove is operable to rotate the tenon 44 from a storage position and move it upwardly into engagement with the upper notch 78 of the fitting 19. The hook member 54 of the tenon 44 has a linear edge that is substantially complementary to the upper, internal elongate apex surface configuration of the notch 78 and when engaged therewith achieves a linear point-to-point contact therebetween.

It should be noted that when the vise bar 28 exerts downward pressure against the top side surface of the flange 64 and the hook member 54 exerts an upward pressure against the notch 78 of the fitting 19 concomitant inward horizontal pressures are exerted against the trailer to thereby assist stabilization thereof during lifting and transporting the working load from one location to another.

It will be understood that various trailer and container manufacturers have several and differing requirements as to dimensions, structural designs and configurations that might necessitate slightly different physical dimensions, in the manufacture of the side fitting 19. Thus, one or more builders of trailers or containers might desire different physical dimensions, for example, in length and thickness of flanges 64 and 66, configuration of upper notch 78, and the like. It is the intent of the present invention to include herewithin any and all modifications of side fitting 19 that may be adapted to the specific requirements of a manufacturers of trailers and containers. It will be further noted that the shorter length of flange 64 as shown in FIG. 9 is particularly adaptable for installation on trailers constructed from a frame-less or parallel design and the flange 64 of FIG. 7 is more adaptable to post or frame design trailers.

In the operation of the present invention, the spreader assembly 16 is positioned over and about a truck trailer or a cargo container 18. The side latch assembly 20 is lowered until its horizontal beam is in proximity to the top side of the trailer as determined by sensor 58, in a manner that prevents the twist lock mechanism from making contact with its twist lock receptacle or connector fitting located on the top of the trailer. The side latch assembly 20 descends until the landing pad 60 makes contact with the flange 64 of the fitting 19. Simultaneously, the latch arm 24 descends along side of the fitting 19 as guided by the alignment pad 62. The piston 36 is lowered to a position where the hook member 54 is disposed below the notch 78 of the fitting 19. Simultaneously, the tenon 44 is rotated downwardly and outwardly from its storage position. The arm 24 is then raised to move hook 54 into interlocking engagement with notch 78. The interlocking engagement between the side latch assembly 20 and the fitting 19 results in a vertical force pressing downwardly on the flange 64 of the fitting 19 and a like vertical force pressing upwardly between the hook 54 and the notch 78 so as to hold the trailer in vise-like connections at four external locations thereon. To disengage the hook from the fitting, arm 24 is lowered and the piston is then retracted to rotate the tenon upwardly and inwardly and return it to a position of stowage. Consequently, the side latch assembly of the present invention is capable of lifting a truck trailer or a cargo container from its top side, rather than from its bottom side by grapple arms, and thereby lift and move the trailer in a more efficient, less time consuming manner. By comparison, utilization of grapple arm technology results in 20–30 seconds per cycle, while the present invention achieves the same results in approximately 7 seconds per cycle.

It will be noted the present invention is especially adaptable for installation on all truck trailer and cargo containers, ranging in lengths, for example, such as the 20, 40, 45, 48 and 53 feet size structures currently produced by a number of well known manufacturers. The side fitting connection member of the present invention may be adapted to any span length ranging from 20 feet and upwardly, so long as appropriate and adequate engineering design criteria are adopted and maintained.

It will be further noted that when the side latch assembly means and the side fitting connection means are in the engaged position and exerting a vice-like grip on the trailer, there is obtained an enhanced structural integrity throughout the trailer and there is also obtained a transfer of moment forces that flow upwardly through the side latch assembly to the spreader and crane apparatus. Thus, it would be possible to lift and move the trailer even if there could occur certain structural degradation throughout the roof, walls and floor of the trailer.

While the present invention has been described with reference to the above preferred embodiments, it will be understood by those skilled in the art, that various changes may be made and equivalence may be substituted for elements thereof without departing from the scope of the present invention. In addition, modifications may be made to adapt a particular situation or material to the teachings of the present invention without departing from the scope of the present invention. Therefore, it is intended that the invention not be limited to the particular embodiments disclosed for carrying out this invention, but that the present invention includes all embodiments falling within the scope of the appended claims.

We claim:

1. A side fitting connection member for attachment to an external surface of an upper side wall of a load carrying structure used for intermodal transportation comprising a generally rectangularly shaped body member, horizontal flange means extending outwardly from the body member at a direction normal thereto, said body member having formed therein at an upper half thereof a generally triangularly shaped cavity means wherein an apex is disposed adjacent to an upper horizontal edge of the body member, said body member having formed therein at a lower half thereof a generally rectangularly shaped box-like receptacle means including vertical side walls, an upper horizontal notch means and a back wall having a ramp wall section merging with said back wall, and said back wall having an upper horizontal edge merging with said upper horizontal notch means.

2. A side fitting connection member for attachment to an external surface of an upper side wall of a load carrying structure used in intermodal transportation comprising a generally rectangularly shaped body member, horizontal flange means extending outwardly from the body member at a direction normal thereto, said body member having formed therein at a first side thereof a generally triangularly shaped cut-out cavity section wherein an apex is disposed adjacent to an upper horizontal edge of the body member, said body member having formed therein at a second side thereof a generally rectangularly shaped box-like receptacle including vertical side walls, an upper horizontal notch means and a back wall having a ramp wall section merging with said back wall, said back wall having an upper horizontal edge merging with said upper horizontal notch means.

3. A load carrying structure used for intermodal transportation comprising, a plurality of side fitting means mounted at predetermined external upper side locations on said load carrying structure and spaced apart so as to provide preselected span lengths therebetween, each said side fitting means comprising a generally rectangularly shaped body member, horizontal flange means extending outwardly from the body member at a direction normal thereto, said body member having formed therein at a first side thereof a generally triangularly shaped cut-out cavity section means wherein an apex is disposed adjacent to an upper horizontal edge of the body member, said body member having formed therein at a second side thereof a generally rectangularly shaped box-like receptacle means including vertical side walls, an upper horizontal notch means and a back wall having a ramp wall section merging with said back wall, said back wall having an upper horizontal edge merging with said upper horizontal notch means.

4. A load carrying structure as claimed in claim 3 wherein said side fitting means is located and positioned at each of the four corners of the structure.

5. A load carrying structure as claimed in claim 3 wherein said side fitting means includes attachment receiving means for engaging with gripping means of a side latch assembly so as to lift the structure.

6. A load carrying structure as claimed in claim 3 wherein said structure comprises a truck trailer.

7. A load carrying structure as claimed in claim 3 wherein said structure comprises a cargo container.

8. A load carrying structure used for intermodal transportation comprising, a plurality of side fitting means mounted at predetermined external upper side locations on said structure and spaced apart so as to provide preselected span lengths therebetween, a generally rectangularly shaped body member, horizontal flange means extending outwardly from the body member at a direction normal thereto, said body member having formed therein at an upper half thereof a generally triangularly shaped cavity section means wherein an apex is disposed adjacent to an upper horizontal edge of the body member, said body member having formed therein at a lower half thereof a generally rectangularly shaped box-like receptacle means including vertical side walls, an upper horizontal notch means and a back wall having a ramp wall section merging with said back wall, said back wall having an upper horizontal edge merging with said upper horizontal notch means.

9. A structure as claimed in claim 8 wherein said side fitting means is located and positioned at each of the four corners of the structure.

10. A structure as claimed in claim 8 wherein said side fitting means includes attachment receiving means for engaging with gripping means of a side latch assembly so as to lift the structure.

11. A load carrying structure as claimed in claim 8 wherein said structure comprises a truck trailer.

12. A load carrying structure as claimed in claim 8 wherein said structure comprises a cargo container.

* * * * *